US005303978A

United States Patent [19]

Murrey

[11] Patent Number: 5,303,978

[45] Date of Patent: Apr. 19, 1994

[54] REPLACEMENT SEAT AND BACK

[75] Inventor: Gordon W. Murrey, Torrance, Calif.

[73] Assignee: GKM Int'l, Redondo Beach, Calif.

[21] Appl. No.: 993,131

[22] Filed: Dec. 18, 1992

[51] Int. Cl.[5] ..... A47C 7/14

[52] U.S. Cl. ..... 297/230.12; 297/452.14; 297/DIG. 2

[58] Field of Search ..... 297/218, 219.1, 229, 297/230.1, 230.12, DIG. 2, 452.14

[56] References Cited

U.S. PATENT DOCUMENTS

| | | | |
|---|---|---|---|
| 2,738,835 | 3/1956 | Eames | 297/218 |
| 2,760,562 | 8/1956 | Fisher | 297/DIG. 1 |
| 3,061,374 | 10/1962 | Grosfillex | 297/445 |
| 3,281,185 | 10/1966 | Albinson et al. | 297/452 |
| 3,596,989 | 8/1971 | Van Ryn | 297/219 |
| 3,647,260 | 3/1972 | Grant et al. | 297/219 |
| 4,828,320 | 5/1989 | Saiger | 297/229 |

FOREIGN PATENT DOCUMENTS

| | | | |
|---|---|---|---|
| 1163169 | 2/1964 | Fed. Rep. of Germany | 297/218 |

*Primary Examiner*—Peter M. Cuomo
*Assistant Examiner*—Darnell M. Boucher
*Attorney, Agent, or Firm*—Roger A. Marrs

[57] ABSTRACT

A replacement seat and back is disclosed for installation onto an existing chair which includes a unitary molded construction with a seat supporting a substantially upright back joined by an integral curved portion. The back is provided with a hollow interior with a slotted entrance adjacent to the curved portion so as to insertably receive the back of the existing chair. The seat includes an edge marginal downwardly depending attachment flange constituting a snap-on attachment for securing the seat to the existing seat. Preferably, the contour, color and overall shape of the replacement seat and back conforms with the contour, color and overall shape of the existing chair.

4 Claims, 1 Drawing Sheet

REPLACEMENT SEAT AND BACK

BACKGROUND OF THE INVENTION

1. Field of the Invention

The present invention relates to the field of furniture, such as chairs, and more particularly, to a novel replacement seat and back combination adapted to be installed over an existing seat and back serving as a replacement of worn out or discolored chair seats and backs.

2. Brief Description of the Prior Art

In many public areas, such as bowling alleys or the like, a multiplicity of chairs are employed to accommodate customers and the general public. Normally, these chairs are of a mass production design and of low cost so as to permit commercial usage. However, problems and difficulties have been encountered with such chairs or seats, which stem largely from the fact that colors fade, plastic construction cracks, wear and tear destroys visual appeal, and the like. It is the conventional practice to replace such seats and seat backs by disassembling the worn seat from its supporting stanchion or legs, followed by procuring a replacement seat that can be installed on the stanchion or legs. Such a procedure requires the usage of tools and requires disassembly of the seat from the stanchion so that the worn out seat can be discarded and a brand new seat substituted therefor. In other instances, it is common practice to throw the entire seat, stanchion or legs away and replace with a complete chair assemblage. Obviously, any of these prior procedures is expensive, time-consuming, and requires skill to repair or replace.

Therefore, a long-standing need has existed to provide a simple and economical means for replacing the seat and back of a chair which does not require skill on behalf of personnel. Such a means for replacement must include conformal fitting and color coordination.

SUMMARY OF THE INVENTION

Accordingly, the above problems and difficulties are obviated by the present invention which provides a novel replacement seat and back as an integral unit adapted to be installed over the worn-out back and seat of a chair. The replaceable seat and back of the present invention includes a seat and back that conforms with the seat and back of the chair wherein a curved or arcuate portion integrally attaches the seat to the back so that a unitary construction is produced. The replacement back includes an enlarged recess having an opening leading into the recess at the bottom of the back adjacent to the arcuate portion so that the back of the worn-out chair may be insertably received into the back recess. The replaceable seat includes a downwardly depending flange adapted to be snapped about the periphery of the worn-out seat of the existing chair so that the replacement back and seat are assembled with the worn-out back and seat of the existing chair. In one form, the snap-lock attachment means includes the flange carried about the edge marginal periphery of the seat about its sides and front having a cavity or groove between the flange and the underside of the seat adapted to receive the thickness of the existing chair seat.

Therefore, it is among the primary objects of the present invention to provide a novel replacement seat and back for an existing chair that may be readily assembled onto the worn-out seat and back so that disassembling of the existing chair is not necessary.

Another object of the present invention is to provide a novel replacement seat and back for an existing chair which combines with the existing seat and back so that color coordination and conformal fitting is provided.

Still a further object of the present invention is to provide a novel economical and non time-consuming means for substituting a replacement seat and back for a chair which may be readily placed over the existing and worn-out seat and back and subsequently snap-locked in attachment thereto.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
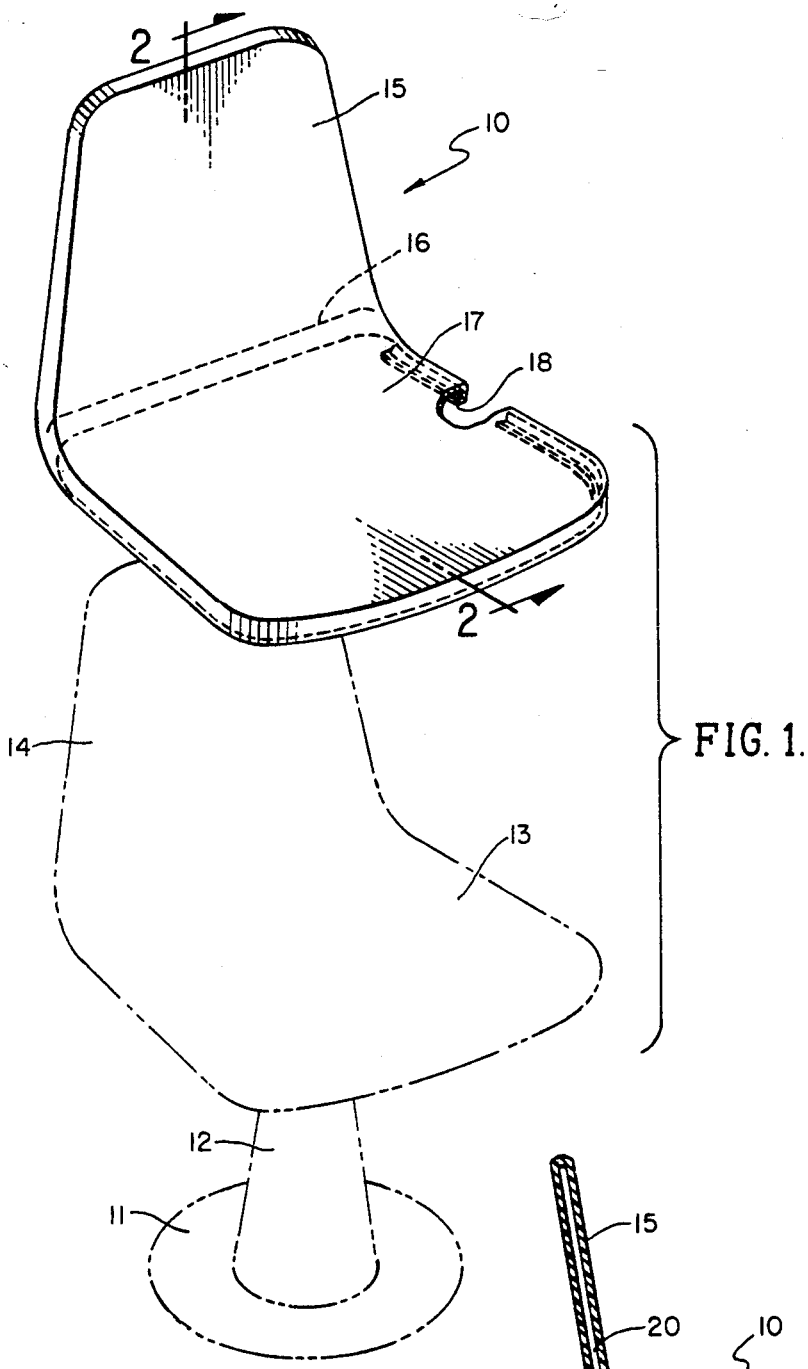
FIG. 1 is a perspective exploded view showing the novel replacement seat and back of the present invention preparatory for assembly on an existing chair.

Referring to FIG. 1, the novel seat and back replacement is indicated in the general direction of arrow 10 which incorporates the invention and is to be employed in connection with an existing chair, such as outlined in dotted lines. The existing or conventional chair may include a base 11 for supporting a chair pedestal 12 or, in some instances, legs or the like, on which a seat is carried, as indicated by numeral 13. The seat incorporates a back 14 as an integral part and the seat and back are carried on the top of stanchion or pedestal 12 by conventional bolt and nut arrangements. However, during the course of usage, the color, surface texture, damage or the like to the seat or back may occur which would require replacement. As mentioned previously, it is customary to replace the entire chair, including the pedestal and base, or at least the bolt and nut attachment arrangement must be disassembled in order to permit removal of the existing seat and back with subsequent replacement by a brand new unit.

However, in accordance with the concept of the present invention, the replacement seat and back 10 is intended to be placed over the back 14, initially, and then pressed against the seat 13 so that the replacement 10 becomes the actual seat and back of the chair. In this connection, the seat and back of the replacement 10 is of the same color or hue as the existing seat and back, and the contour, including curvatures and configuration, are conformal therewith.

It is noted that the back of the replacement 10 is indicated by numeral 15 and includes a hollow interior having an opening 16 leading into the interior from the back side of the back 15. It can also be seen that the replacement seat is indicated by numeral 17 and includes a snap-lock fastening means, indicated by numeral 18, for engaging with the edge marginal region of the original or existing seat 13.

Figure 2:
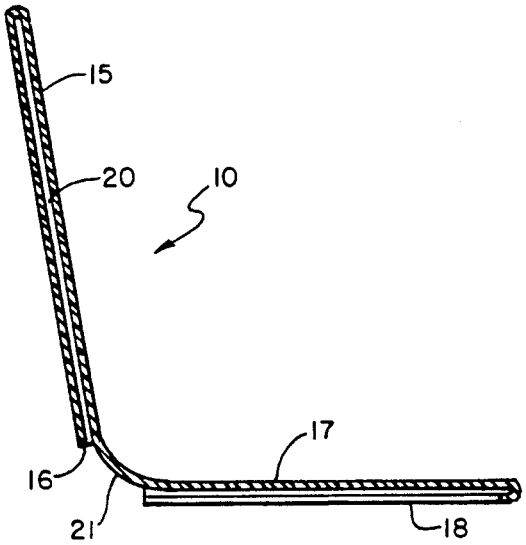
FIG. 2 is a transverse cross-sectional view of the replacement seat and back as taken in the direction of arrows 2—2 of FIG. 1.

Referring now in detail to FIG. 2, the recess or hollow of the back 15 is indicated by numeral 20 and it can be seen that the entrance 16 leading into the recess 20 is on the back side of the back 15 adjacent to an arcuate or curved portion 21 which integrally connects with the seat 17. Preferably, the replacement seat 10 is composed of a moldable composition such as plastic or the like and that it is of unitary construction so that a one-piece structure is provided.

Figure 3:
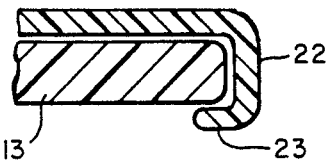
FIG. 3 is an enlarged fragmentary view, in section, of the edge marginal region of an existing chair seat with the snap-lock attachment means of the replaceable seat.

Referring now in detail to FIG. 3, the fastening means 18 may take the form of a downwardly depending flange 22 having an inwardly directed lip 23 adapted to snap over the peripheral edge of the existing seat 13 so that the lip resides under the edge marginal region of the seat. This arrangement fixedly secures the replacement seat 10 onto the existing seat 13. The member 22 and lip 23 extend around the two sides and front end of the seat 13 and present a continuous flange and lip terminating only at the opposite sides of seat 13 adjacent to the arcuate portion 21. It is noted that the fastening means 18 and the entrance 16 leading into the cavity 20 of the back 15 terminate on the back side of the replacement seat and back 10 and are adjacent to the arcuate portion 21.

In view of the foregoing, it can be seen that the novel replacement seat and back 10 may be easily installed over an existing seat and back by initially inserting the top of the existing back into the recess 20 through the entrance 16 of back 15. As the existing back is slid into the recess, the top of the existing back will engage or abut against the end of the recess at which time the fastening means 18 about the sides and front of the seat 17 may be snapped over the edge of the seat 13 of the existing chair. Removal can be achieved by reversing the process and prying the lip 23 over the seat edge 13 to disengage the fastening means whereby the replacement seat can be lifted from the existing seat.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A covering for a chair seat and back comprising:

a unitary construction having a seat and a back;

an arcuate portion integrally connecting said seat with said back so that said back projects substantially normal to said seat;

said seat having a flat portion with a downwardly depending peripheral flange defining a space for the chair seat;

said back having an internal pocket cavity defined by a pair of spaced-apart front and rear panels with side panels securing said front and rear panels together to create an entrance leading into said pocket cavity adjacent to said arcuate portion; and connection means carried on said peripheral flange for detachably connecting said seat; and wherein said side panels and said peripheral flange are continuous at said arcuate portion.

2. The covering as defined in claim 1 wherein:

said connection means comprises a lip inwardly disposed from the downwardly depending flange which, in cooperation with said pocket cavity, constitutes a retaining means.

3. In a covering seat and back for an existing chair having a seat and a back, the combination comprising:

a unitary cover construction having a seat cover and a back cover;

an arcuate portion integrally connecting said seat cover with said back cover so that said back cover projects substantially normal to said seat cover;

said back having sidewalls which connect two spaced-apart walls;

said walls and sidewalls defining an internal cavity with an elongated entrance adjacent to said arcuate portion leading into said cavity for insertably receiving and completely covering the existing chair back;

said seat cover having a peripheral edge;

connection means carried on said seat cover peripheral edge for detachably connecting with the existing chair seat in cooperation with said back cavity entrance for retaining said unitary construction;

said connection means comprises a downwardly depending flange from said peripheral edge of said seat cover with a lip inwardly disposed to engage under said seat cover peripheral edge;

said flange and said lip having opposite ends that are continuous with said sidewalls at said arcuate portion; and said unitary construction is composed of a single piece molded plastic.

4. The invention as defined in claim 2 wherein said unitary construction is composed of molded plastic.

* * * * *